United States Patent [19]

Gaudelli et al.

[11] 4,067,941

[45] Jan. 10, 1978

[54] PROCESS FOR PRODUCING SLABS FROM POURED CONCRETE

[76] Inventors: Edmond N. Gaudelli, 2438 Hayson Ave., Pittsburgh, Pa. 15220; Edward E. Shepler, 1733 Potomac Ave., Dormont, Pa. 15216

[21] Appl. No.: 608,469

[22] Filed: Aug. 28, 1975

[51] Int. Cl.[2] ..... B28B 1/08

[52] U.S. Cl. ..... 264/69; 249/120; 249/129; 249/171; 264/297

[58] Field of Search ..... 249/119, 120, 129, 170, 249/171, 172; 264/297, 69

[56] References Cited

U.S. PATENT DOCUMENTS

| | | | |
|---|---|---|---|
| 1,314,018 | 8/1919 | Pipe | 249/120 X |
| 1,642,247 | 9/1927 | Krause | 249/129 X |
| 1,760,282 | 5/1930 | Pedersen | 249/137 X |
| 2,560,781 | 7/1951 | Schoaf | 264/297 X |
| 2,983,983 | 5/1961 | Mayer | 249/129 |

*Primary Examiner*—Thomas P. Pavelko
*Attorney, Agent, or Firm*—John A. Young

[57] ABSTRACT

A series of mold cavities are made up of side plates which are pivoted on vertical offset hinges and each is movable one toward the other to define the mold cavities into which concrete is poured to form the slab. Certain of the vertical side walls have integrally related lateral wall elements which separate the side walls and complete the enclosure for the mold cavity. After the slabs have hardened, the side walls are forced apart by prying them at their upper corners causing each in turn to pivot on its respective axis and thereby opening the individual mold cavity and allowing withdrawal of the hardened slab therein.

3 Claims, 5 Drawing Figures

PROCESS FOR PRODUCING SLABS FROM POURED CONCRETE

BACKGROUND OF THE INVENTION

This application is related to my copending application Ser. No. 485,767 filed July 5, 1974, "IMPROVED APPARATUS AND METHOD FOR MAKING SLABS."

The present application differs from my copending application in that the mold cavity which is made up of the vertical side wall members, is enclosed at its lateral sides, not by a continuous wall, but instead by individual wall sections which define the lateral spacings between the side wall members and further serve to enclose the mold cavity. Consequently, a series or composite of such cavities form the complete mold and the cavities are simultaneously filled during a single mold pour.

In our previously filed application, we disclosed a mold construction with which we successfully constructed many thousands of slabs employing the mold principle disclosed in U.S. Ser. No. 485,767. However, it has been found that it is difficult and time consuming to use a mold in which the mold is disassembled by removing exterior walls therefor. In this present invention, we make lateral wall sections integral with the vertical side walls and these integrally related lateral walls serve both as part of the individual mold cavity enclosure and define the fixed distance between the side walls when the side walls are rotated toward one another and are regularly spaced apart in parallel positions.

OBJECTS OF THE INVENTION

It is one of the principal objects of the present invention to provide a mold in which the individual mold cavities are defined by side wall members pivotally mounted on offset axes so that each side wall can be pivoted on its vertical axis thereby enabling extraction of the molded slab formed from concrete poured within the space between adjacent pivotable side walls.

Another object of the present invention is to provide a series of mold cavities made up of pivotable side wall members in which the lateral sides are defined by sections which are integrally related with the pivotable side walls and are transverse thereto so that as the pivotable movement of the side walls are brought one toward the other, the lateral spacing is defined by engagement of the lateral side walls with the confronting surfaces of a respectively opposed side wall. Thus, the mold cavity is made up of complementary pivotable side walls and lateral side walls integrally related one with each lateral edge of a respective side wall.

It is another object of the present invention to hold in clamped relationship all of the pivoted side walls of the mold by a simple clamping member which extends between the remote ones of the side walls and draws them together so that each side wall is held in rigid concrete receiving position, defining the dimensions of the mold cavity and in such condition is adapted to receive the incoming flow of concrete molded into the shape defined by the respective cavities of the mold. The construction is rigid so that it will not lose its divisional integrity under the weight of the concrete poured into the cavity.

An overall object of the present invention is to improve generally our previous mold system disclosed and described in copending application Serial No. 485,767 by replacing the outer wall members of the mold cavity and substituting instead integrally related side walls one associated with each of the sides of each side wall member so that when the intermediate side wall members are aligned in parallel relation, there are a series of mold cavities spaced one adjacent the other and each adapted to receive a cementitious material therein to form slabs within the mold cavities.

Other objects and features of the present invention will become apparent from a consideration of the following description which describes in detail a selected example embodiment. The description proceeds with reference to the accompanying drawings.

DRAWINGS

DETAILED DESCRIPTION OF THE INVENTION

Figure 1:
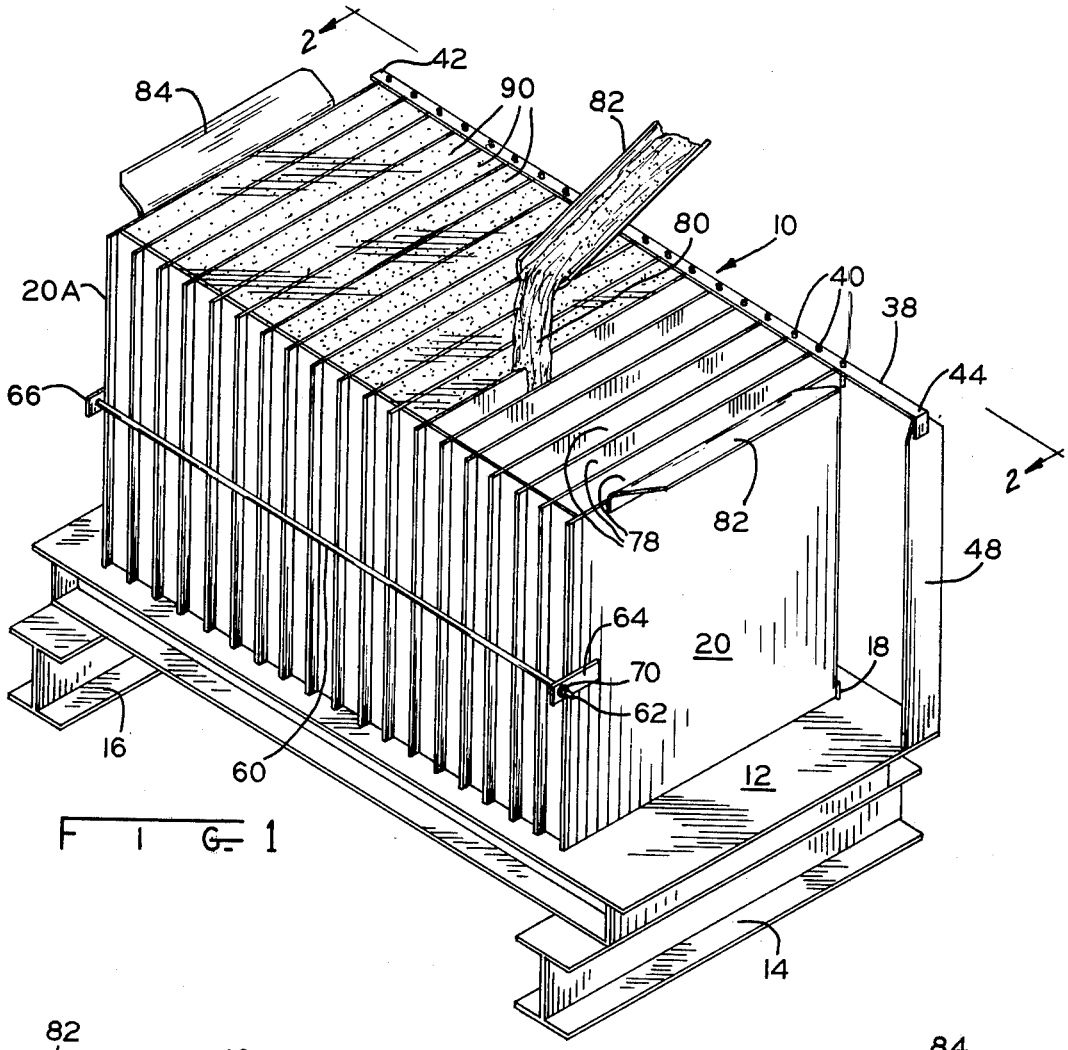
FIG. 1 is an isometric view of the mold cavities as they are clamped together and adapted to receive the charge of cementitious material therein to form a slab one within each of the respective mold cavities.
Figure 2:
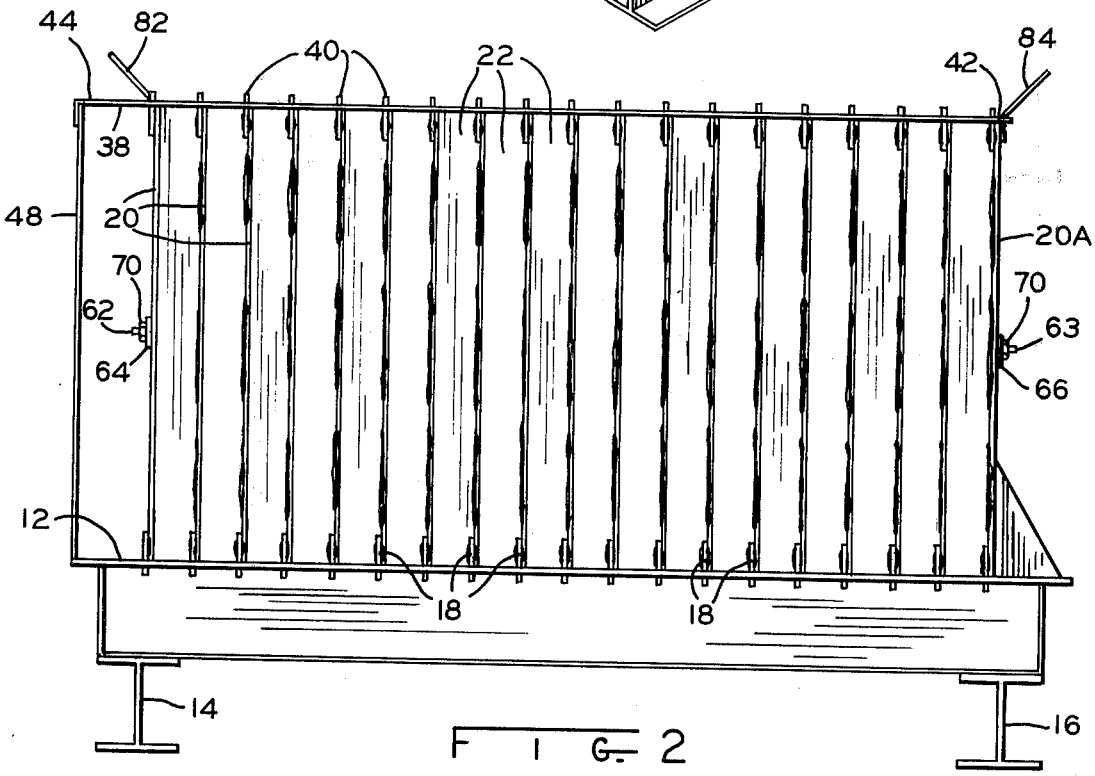
FIG. 2 is a side elevation view looking in the direction of the arrows 2—2 in FIG. 1.

Referring to FIG. 1, a mold bed designated generally by reference numeral 10 includes a base 12 which is supported at its opposite ends on I beams 14 and 16.

Extending upwardly from the base 12 are a number of vertical posts 18 which serve as vertical axes of rotation for side wall members 20. Each intermediate side wall member has an integrally related lateral wall section 22 at the pivoted end and a lateral side wall 24 at the free or non-pivoted end so that when the respective wall elements 20 are pivoted to a closed position, the lateral wall elements 22 at the pivoted end produce cumulatively a continuous side wall at side 30 and the lateral wall elements 24 cumulatively produce a side wall at side 32.

Figure 4:
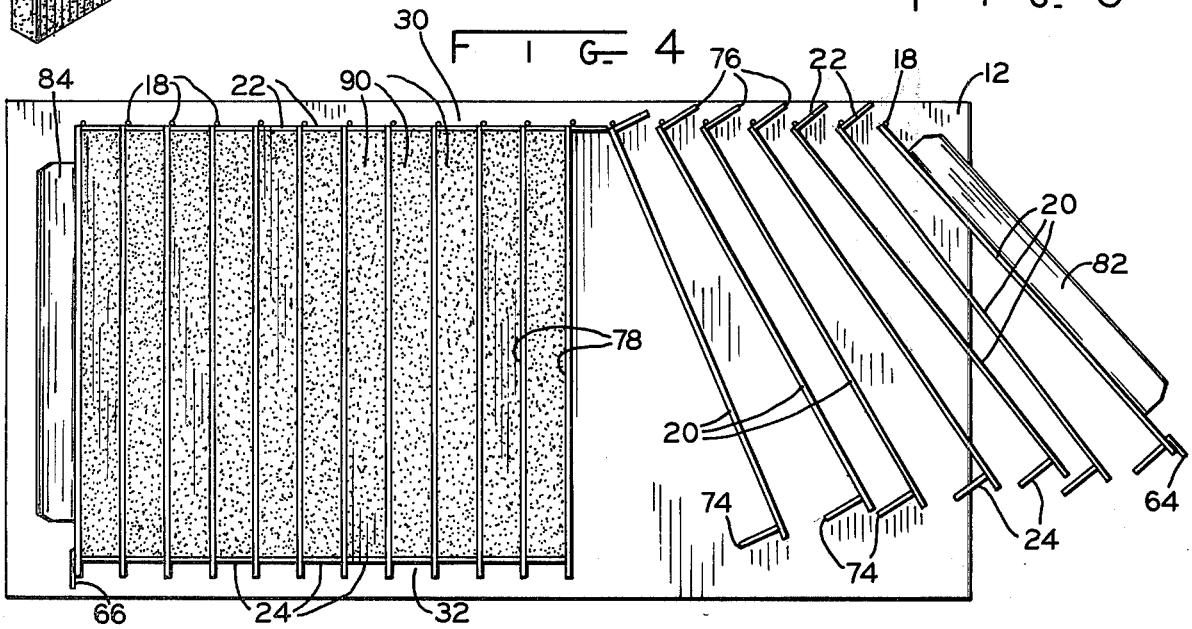
FIG. 4 is a top view of the mold cavity shown partly emptied of slabs by the progressive breaking apart of the side walls of the mold looking in the direction of the arrows 4—4 of FIG. 3.

It should be noted that the vertical axes 18 are offset to permit free movement of the wall elements 20 in a counterclockwise opening movement (FIG. 4) and permit clockwise closing direction in preparation for a pour.

Figure 3:
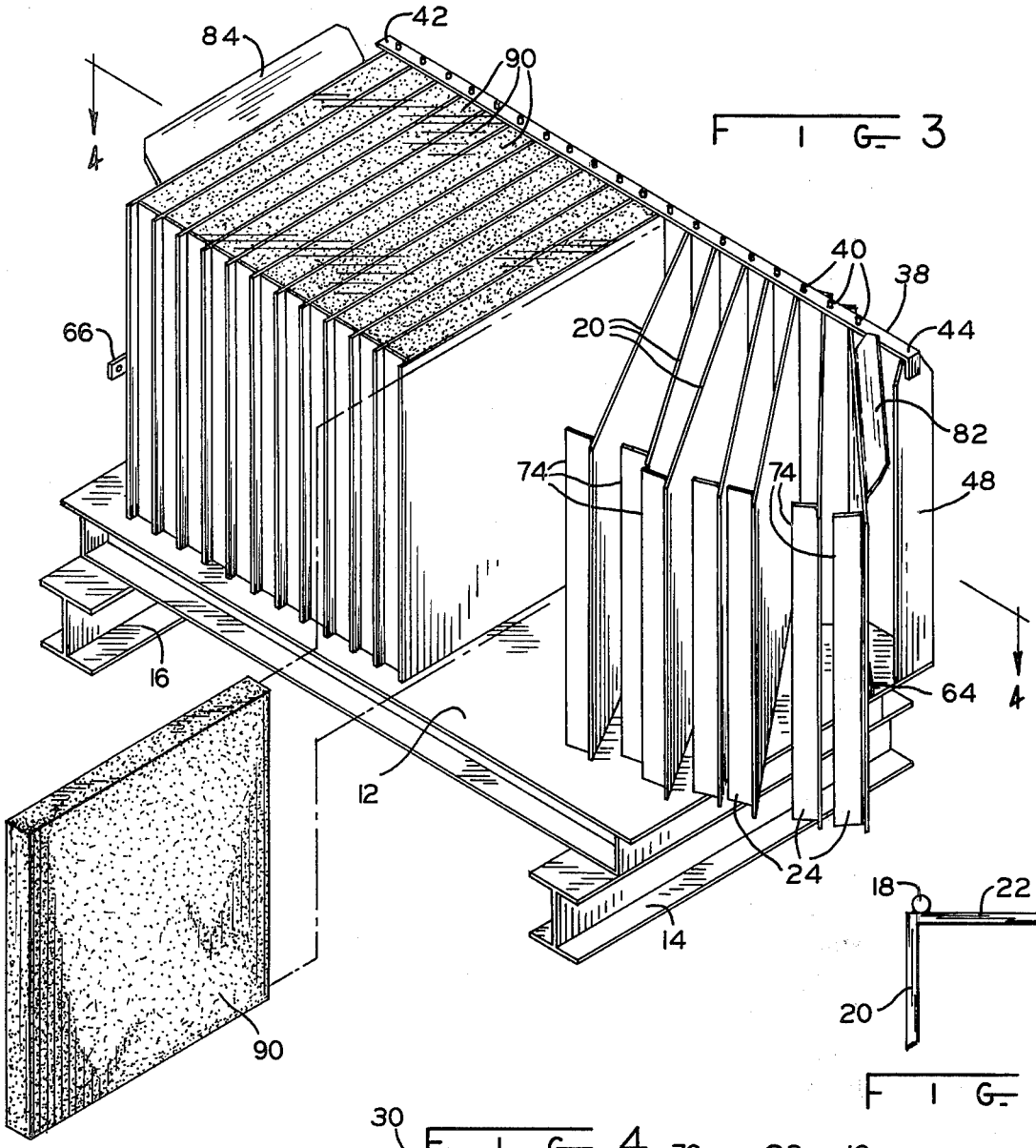
FIG. 3 illustrates the mold bed as certain of the side walls are pried apart, some of the side walls being shown pivoted one away from the other, to release the slabs within the mold cavities and one of the slabs being illustrated removed from its associated cavity.
Figure 5:
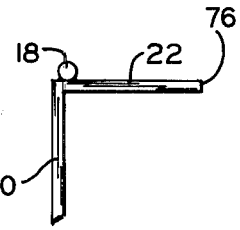
FIG. 5 is a detail view illustrating the hinge connection for the side walls.

The posts 18 which define the axes of rotation are held by means of a horizontal cross bar 38 which receives ends 40 of posts 18 therein (FIG. 3) and the end 44 is held by vertical stiffening member 48. Stiffening member 48 is welded onto the base 12.

When all of the side wall elements are in closed position, they are clamped together by means of a rod 60 having ends 62 and 63 which pass through companion openings in metal straps 64 and 66 which are welded onto the remote side walls 20 and 20A (FIG. 1). Nuts 70 are then used to draw the remote side wall together and therefore the intermediate side walls 20 are urged together.

The nuts 70 are then drawn snug and the outermost side walls 20 and 20A draw all of the side members together and hold them in the position shown on FIG. 1, wherein the edges 74 of the lateral wall elements 24 are brought against the opposed confronting surfaces of the adjacent side wall members. There is thus made a rigid enclosure at side 32 (FIG. 4) and the edges 76 of lateral side wall elements 22 at side 30 are also brought against the confronting surfaces of the adjacent side wall elements so that they also assist in forming distinct mold cavities or compartments 78, each of which is adapted to receive a charge of concrete therein as indicated by the incoming flow 80 from chute 82 (FIG. 1). As the side walls 20 are swung into parallel relation, the lateral edges 74 and 76 of the lateral side wall sections 22 are simultaneously brought into confronting contact with opposing surfaces of the adjacent side walls, and this defines the plurality of spaces between the lateral edges of the plates forming the side-by-side compartments. A vibrator is used to ensure that there is a complete filling of all the voids within the cavity. Once all the mold cavities 78 are filled with concrete and the concrete vibrated to ensure complete filling of all the voids, the concrete is then hardened and the tension rod 60 is removed by loosening the nuts 70 and withdrawing the rod.

During the pouring process, inclined shields 82 and 84 on the end wall elements 20 and 20A direct incoming concrete towards the contiguous mold cavities.

After the product is hardened into slabs, the slabs are removed by sequentially prying each of the individual wall elements 20 away, one from the other by prying adjacent wall elements apart, thus opening them in much the same manner as the pages of a book. As the side wall elements 20 are brought apart, the slab 90 (FIG. 3) is freed from within the cavity.

This process is continued until all of the mold cavities are opened by sequentially prying apart one and then the next succeeding side wall, thereby completely emptying all of the mold cavities of their slab contents, which now being hardened are self-supporting and are removable.

If the slabs 90 are green, they can be aged in storage before use. The mold cavities are then reused by swinging the side walls to closed positions (clockwise, FIG. 4) bringing all of them into closed position as shown in FIG. 1, reinserting the tension rod 60 and by means of the nuts, drawing the two end side wall members 20 and 20A together as the mold cavities are once again completely closed together and are ready for receiving additional concrete, as shown in FIG. 1.

The entire operation takes place semi-continuously, first closing the side wall elements 20 to form the mold cavities, charging the mold cavities with concrete, allowing the concrete to harden within the mold cavity and breaking apart the side wall members to release the hardened slab within the respective mold cavities.

OPERATION

In operation, the side walls 20 are coated with release agents so that concrete will not stick to the side thereof. The composition of the release agent is fully described in our issued U.S. Pat. No. 3,426,122 issued Feb. 4, 1969.

Next, the side wall elements 20 through 20A are drawn together by rotating them on their respective axes 18 so that all are drawn together by the rod 60 or nuts 70 are turned down. The side walls are all substantially parallel with the relatively fixed non-rotatable end side wall member 20A. Once all of the side wall members are closed, the lateral wall elements 22 and 24 are brought into confronting engagement with the opposing surfaces of the adjacent wall members, thus forming complete cavity enclosures 78. Thereafter, the rigidly held together side and lateral walls are retained against movement and both the top and bottom edges are reinforced to preclude movement as concrete product pours into the cavities in the manner indicated by flow 80 from chute 82 in FIG. 1.

After the mold cavities are completely filled, and the concrete subjected by an agitator, to ensure complete filling of all the voids within the mold cavity, the concrete then hardens in the respective mold cavity. After hardening, the tension rod 60 is removed and a lever (not shown) operating against the upper corners of the unhinged ends of the side walls are pried apart so that each side wall 20 is successively sprung away from the adjacent side wall (FIG. 4) and enabling release of the hardened slabs 90 therein in a manner indicated by the removal of slab 90 in FIG. 3.

The operation is sequential, that is each wall element 20 is successively sprung away from the adjacent wall until all of the slabs are removed.

The dimensions of the slab can vary, of course, depending upon design considerations, but typically, the slab can be made from the mold apparatus in the dimensions of $2 \times 18 \times 36$ inches and the mold apparatus can easily make up to 20 slabs simultaneously.

The incoming concrete is generally provided by a ready-mix truck and it can usually be depended upon that the concrete will harden overnight.

True parallel sides are found on the slab and the corners and sides are true, square, sharp and well-defined. The corners are well-defined as are the edges and the products produced are of uniform quality.

One of the substantial advantages of the present invention is that the slabs can be made with a relatively few number of workmen and the schedule of work can be stretched out so that inventory can be stocked, thus making the operating schedule stable even though the demand for slabs is somewhat seasonal.

An important advantage of the present invention is that the device only occupies a relatively small space so it is possible to make a substantial number of units in a confined area, thus contributing to overall economy in that the overhead and burden is relatively slight since we avoid large commitments for floor space, building area, together with heating and air-conditioning requirements.

Reinforcement can, of course, be added to the interior of the slab, again depending on the strength of the slab which is desired; the materials of construction are relatively cheap, easily acquired and are standard.

An important advantage of the present invention is that the slabs are of the same construction and size and can be made over and over again to standard size, construction, composition, strength, etc. without requiring extensive dismantling and reconstruction.

Although the present invention has been illustrated in connection with a single example embodiment, it is understood that this is illustrative of the invention and is by no means restrictive thereof. It is reasonably to be expected that those skilled in this art can make numerous revisions and adaptations and it is intended that such revisions and adaptations will be within the scope of the following claims as equivalents of the invention.

What is claimed is:

1. A process for producing slabs comprising the steps of hingedly mounting on vertical axes a plurality of spaced apart vertical plates forming side walls with each side wall having at opposite edges and opposite sides an integrally related lateral wall elements with lateral edges adapted to engage confronting surfaces of the respectively adjoining side walls, said hinged mounting being located at the intersection of the lateral wall elements and vertical plates along one side only of such plates, enclosing the spaces between the lateral edges of each of said plates by hingedly swinging the respective side walls into parallel relation and simultaneously bringing the opposite lateral edges at the opposite sides of said respective side walls into confronting contact with the opposing surfaces of adjacent side plates and thereby defining a plurality of spaces between the lateral edges of said plates to form a series of side-by-side compartments, clamping said vertical plates together to maintain the enclosure between the sides of said plates, filling the compartments with concrete substantially hardened therein to form slabs, and then releasing said slabs by serially swinging the vertical plates apart to release the completed slabs by separating such vertical plates.

2. The process in accordance with claim 1 including the steps of agitating the concrete which is poured into said compartments, retaining the non-hardened concrete within the individual compartments until it forms self-supporting structures to form slabs one within each of said compartments.

3. The process in accordance with claim 1 including the step of releasing the clamping member and thereafter extracting the hardened slabs by effecting successive hinged movements of the vertical side plates one away from the other to disengage the finished slabs from both the side walls and lateral end plates in successive compartments.

* * * * *